United States Patent [19]

Savinov et al.

[11] 4,229,963

[45] Oct. 28, 1980

[54] MACHINE FOR NONCUTTING METAL SHAPING

[76] Inventors: Evgeny A. Savinov, ulitsa Internatsionalnaya, 3, korpus 2, kv. 47; Mikhail I. Baranaev, ulitsa Kombainovaya, 36, kv. 116, both of Ryazan, U.S.S.R.

[21] Appl. No.: 909,992

[22] Filed: May 26, 1978

[51] Int. Cl.[3] ..... B21J 9/18

[52] U.S. Cl. ..... 72/402; 72/450; 72/452; 74/25; 74/45; 74/50

[58] Field of Search ..... 72/402, 452, 449, 450, 72/429; 74/45, 50, 104, 25

[56] References Cited

U.S. PATENT DOCUMENTS

| | | | |
|---|---|---|---|
| 3,165,012 | 1/1965 | Kralowetz | 72/402 |
| 3,224,244 | 12/1965 | Kralowetz | 72/402 |
| 3,572,077 | 3/1971 | Kralowetz | 72/402 |
| 3,871,223 | 3/1975 | Kralowetz | 72/402 |
| 3,908,434 | 9/1975 | Ribback | 72/452 |

*Primary Examiner*—Francis S. Husar
*Assistant Examiner*—Gene P. Crosby
*Attorney, Agent, or Firm*—Haseltine, Lake & Waters

[57] ABSTRACT

In a forging machine where the frictional work is reduced in the driving system at the main crankshaft and its support bearings, especially at the moment a forging force is applied. A rotary driven crankshaft is connected to a crank mechanism, which has a connecting rod connected to the driven crankshaft. The opposite end of the connecting rod is pivotally connected to an arm for driving the main crankshaft in an oscillatory rocking motion, which reciprocates the hammer means.

3 Claims, 4 Drawing Figures

MACHINE FOR NONCUTTING METAL SHAPING

FIELD OF THE INVENTION

The present invention relates to machinery and equipment for noncutting shaping of metals (e.g., by pressure forging, die stamping), and has particular reference to such machines for noncutting metal shaping as crank presses of diverse applications, radial squeezers, and some other machinery, wherein their operative members that exert preassure-shaping effect upon the workpiece being hand-led, perform reciprocating or oscillating motion.

DESCRIPTION OF THE PRIOR ART

In machines for noncutting pressure shaping of metals, the operative member (which is the case with, say, crank, presses) or a plurality of operative members (e.g., in a radial squeezer) perform reciprocating or oscillating motion to exert pressure-shaping effect upon the workpiece being handled. Therefore such machines are provided with a device for converting rotary motion of the drive into reciprocating motion of the operative member, said device comprising a crank mechanism whose translationally traversable unit (such as slide, slot-and-crank, arm, etc.) carries the operative member, while the crankshaft journalled in the annular bearings of the machine frame, is kinematically associated with the rotary-motion drive thereof.

BACKGROUND OF THE INVENTION

Modern production practice imposes quite a number of requirements upon machines for noncutting metal shaping, of which principal are as follows; further rise of productivity and quality of finished products accompanied by reduced power consumption and costs of attendance and maintenance.

The level of productivity of machines for noncutting metal shaping attained up to date, as far as it concerns the problems of automation and mechanization of charging the workpieces and discharge of the finished products, depends predominantly upon the traversing speed of the operative member, i.e., number of its working strokes per unit time which is restricted by a number of factors, of which cardinal ones are: load-carrying capacity of the crankshaft annular sliding-friction bearings, and the state of dynamic balancing of the system "working member—workpiece hand-led—machine frame" (drive inclusive).

Load-carrying capacity of the annular bearings is the function of the peripheral sliding speed (v) thereof and of the specific load (P) imposed thereon. The product of P and v may be assumed practically to be a constant value for the heretofore known materials from which bearings are made, within a certain lapse of time, since said product depends mostly upon the characteristics of the material of the sliding-friction bearing itself rather than upon the parameters of the machine, its particular design features and operation. The machine can be made more speedy due to an increased peripheral speed of the annular bearings, but it involves inevitably a corresponding reduce of the specific load on the bearings so that the problem remains eventually unsolved.

Notice should also be taken of the fact that in machines for noncutting metal shaping, such as radial squeezers, sliding-friction bearings of the crankshaft sustain nominal load exerted by the operative member when the latter produces pressure-shaping effect upon the work-piece being handled, said load being imposed at a certain angle of crankshaft turn called the working angle, with the result that much work of the drive is spent to overcome the forces of friction arising in the bearings. As the production output of the machine rises the amount of power consumed for overcoming the force of friction in the bearings increases so much that the amount of motor power consumed for the purpose gets commensurable with the power required for performing useful work, or even exceeds it by a factor of three or four, which is the case with such machines as radial squeezers. The result is abnormally high heating of the bearings which requires that the machine shall be provided, for attaining stable operation thereof, with automatic lubricant temperature control means, that use be made of special lubricant retaining its viscosity at elevated temperatures, an increased clearances in mating bearings be provided and that the entire system "operative member—workpiece hand-led—bed" be balanced and imparted the state of dynamic stability. As a result, all this complicates the machine, heightens power consumption and costs of attendance and in-service maintenance to such a great extent that application of said machines for accomplishing the functions they perform becomes economically unjustifiable.

Thus, to sum up all the afore-discussed, any increase in the productivity of the currently used crank presses and radial squeezers wherein a crank mechanism taking up nominal force applied for pressure-shaping of the workpiece being handled, is employed as a device for converting rotary motion of the drive into reciprocating motion of the operative member, is restricted by the load-carrying capacity of the crankshaft sliding-friction bearings and the amount of work due to friction arising therein.

OBJECT AND SUMMARY OF THE INVENTION

It is a general object of the invention to obviate the disadvantages mentioned above.

It is an essential object of the present invention to increase the productivity of machines for noncutting metal shaping by attaining higher speed of the operative member thereof.

It is another object of the present invention to cut down power consumption and costs of in-service maintenance of machines for noncutting metal shaping.

In keeping with said and other objects in a machine for noncutting metal shaping, wherein provision is made for a device capable of converting rotary motion of the drive into reciprocating motion of at least one operative member thereof, said device comprising a crank mechanism whose translationally traversable unit carries the operative member, and the crankshaft journalled in annular bearings of the machine frame, is kinematically associated with the rotary motion drive, according to the invention the crankshaft of the crank mechanism is mounted so as to perform oscillating motion, for which purpose its kinematic association with the rotary motion drive is effected by way of a crank-and-pitman mechanism and an arm articulated to the pitman of said mechanism and locked-in with the crankshaft of the crank mechanism.

As a result of substitution of crankshaft rotary motion by oscillating one, with the magnitude of the force exerted by the operative member upon the workpiece remaining unaffected, and the length of reciprocating stroke performed by the operative member falling within the predetermined limits, a possibility is provided to increase the number of strokes of the operative member by at least 25 percent, with the result that the amount of work due to friction in the crankshaft annular bearings is reduced, due to a shorter path whereon the load is imposed, so much that use of bearings made of special materials, as well as special lubricating oils can be dispensed with. This, in turn, adds much to the simplicity of the devices responsible for service durability of the machine mechanisms and reduces the installed power of electric drive.

Moreover, it is due to much less amount of work lost in friction occurring in the crankshaft annular bearings that the clearances therein are substantially decreased which does away with a necessity in balancing the system of the operative member components and considerably improves dynamic conditions of operation of the machine mechanisms, thereby not only simplifying the construction of the machine but also contributing to a higher quality of the finished products.

It is due to appropriately modifying the nature of the crankshaft motion, by way of a modified kinematic association thereof with the drive, that a maximum positive effect is attained.

Further on the present invention is characterized in that the length of the arm is substantially greater than the crank radius of the crank mechanism, a feature that makes it possible to reduce load upon the crankshaft bearings of the crank-and-pitman mechanism so much as to provide a possibility of their application at substantially higher speeds of the operative member. In addition, a possibility arises of using antifriction bearings for the purpose.

It is expedient that the crankshaft annular bearings of the crank-and-pitman or crank mechanism be adapted to traverse with respect to the machine frame during reciprocating motion of the operative member. This makes it possible, on the one hand, to change the distance between the operative members (i.e., adjust the die space), as the system "operative member—crank mechanism—frame" incorporates no other linkages or units capable of changing the distance between the operative members, and on the other hand, this simplifies the construction of the machine, since the same mechanism makes it possible to perform several functions.

It is desirable that the machine frame be provided with a swivel bearing box, wherein located eccentrically to its axis of rotation are the crankshaft annular bearings of the crank mechanism for said annular bearings to traverse with respect to the machine frame, the geometric crank axis passing in front of the axis of rotation of the bearing box and that of the crankshaft of the crank mechanism. As a result load exerted upon the arm and pitman of the crank-and-pitman mechanism can be greatly reduced due to increasing the load component taken up by the swivel bearing box.

BRIEF DESCRIPTION OF THE DRAWINGS

In what follows the present invention is illustrated in a detailed description of a machine for noncutting metal shaping, given with reference to a crank press and radial squeezer, according to the invention, to be considered in conjunction with the accompanying drawings, wherein.

DETAILED DESCRIPTION OF THE INVENTION

Figure 1:
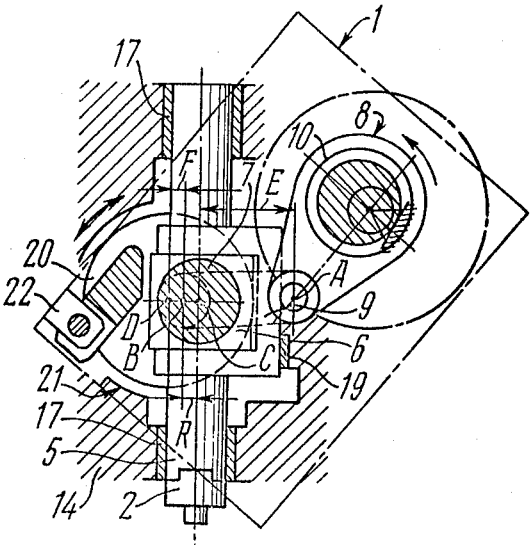
FIG. 1 is a schematic longitudinal section view of a crank press.
Figure 2:
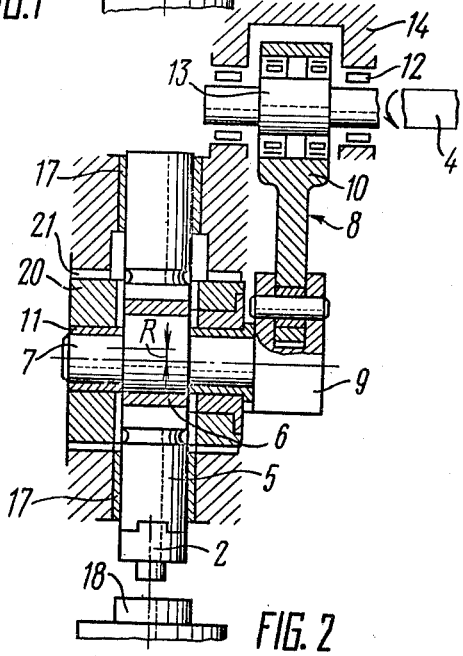
FIG. 2 is the view of FIG. 1 in longitudinal section taken substantially along the annular bearings of the crankshafts of the crank and crank-and-pitman mechanisms.
Figure 3:
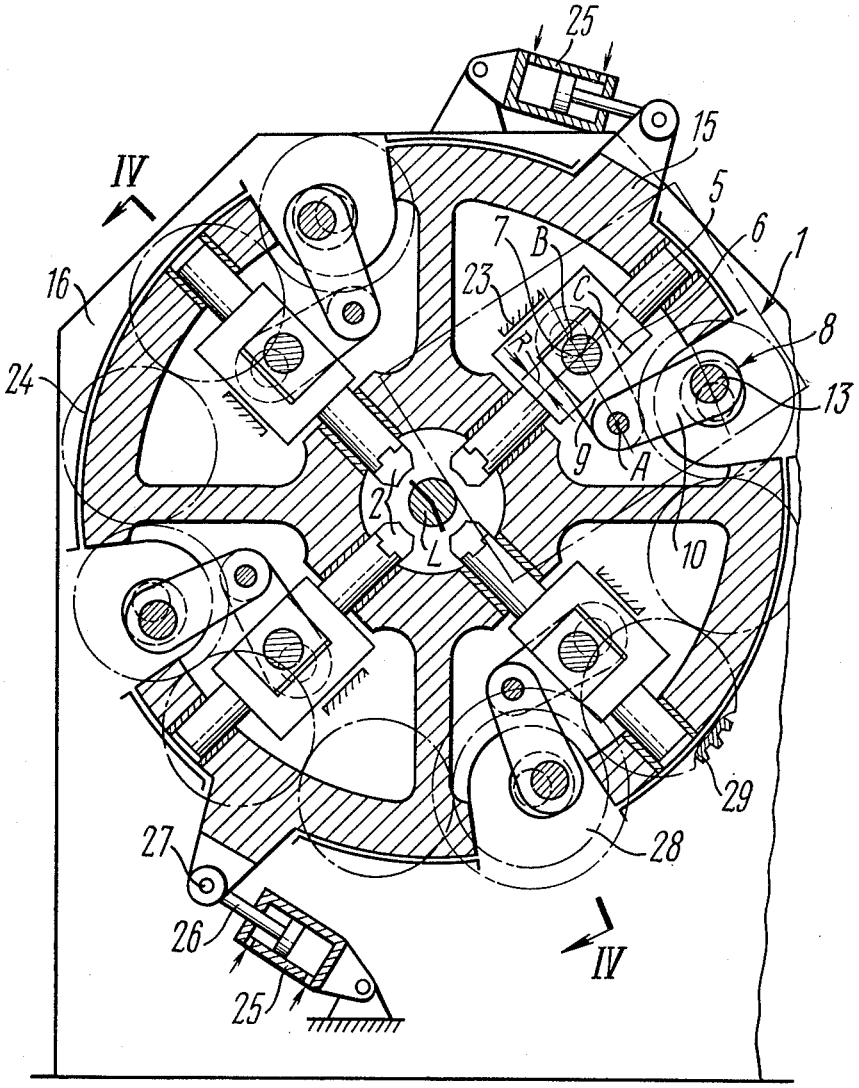
FIG. 3 is a schematic longitudinal section view of a radial squeezer.
Figure 4:
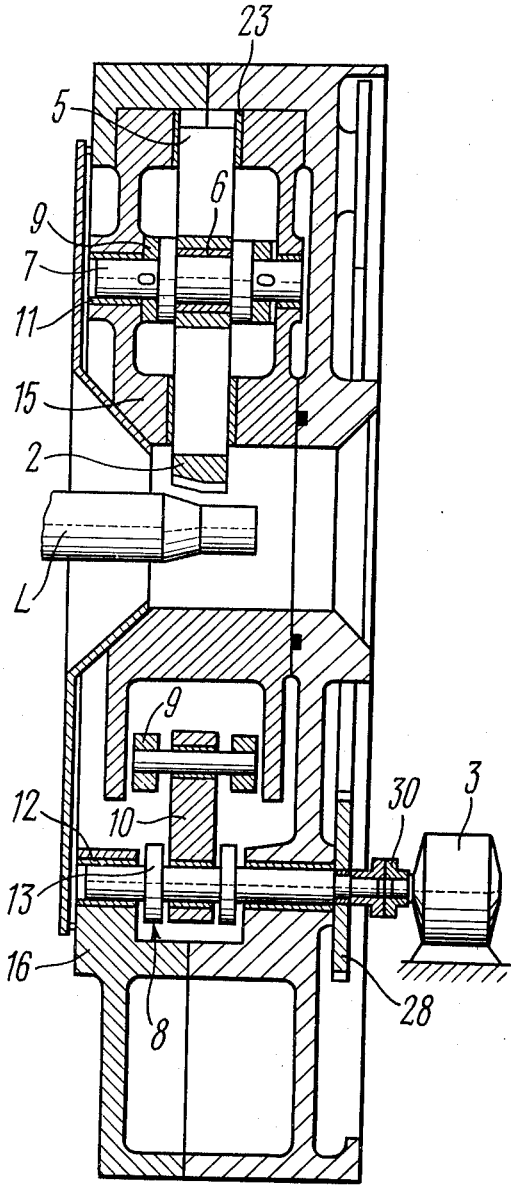
FIG. 4 is a section taken along the line IV—IV in FIG. 3.

Machines for noncutting metal shaping, such as a crank press illustrated in FIGS. 1 and 2, or a radial squeezer shown in FIGS. 3 and 4, feature a conventionally known construction and therefore are left beyond the scope of the present invention and not represented in FIGS. 1 through 4. Said machines feature, apart from frame, operative member and drive, also a device 1 for converting rotary motion of the drive into reciprocating motion of an operative member 2. In as much as the radial squeezer (FIG. 3) incorporates a number of the operative members 2, i.e., strikers each of which is connected to a common drive 3 (FIG. 4) through the device 1, the following disclosure will hereinafter refer to one of the operative members 2, while bearing in mind that all described hereinbelow applies equally to all the operative members of the machine. That is why the operative members of the radial squeezer and the movable portion of the crank press operative member are indicated at the same reference numeral 2.

The device 1 (FIGS. 1 and 3) for converting rotary motion of the drive into reciprocating motion of the operative member 2 comprises a crank mechanism kinematically associated with the drive 3 (FIG. 4) of a radial squeezer, and with the drive of a crank press (FIG. 2), the drive itself being not represented in FIG. 2, since any conventional drive may be made use of as the drive of the given press, a driving shaft 4 alone of said drive being shown in the figure.

Used as a crank mechanism is the slot-and-crank mechanism (which however, by no means avoids the use of some other types of crank gears), whose translationally traversable unit, i.e., slotted link 5 with a slide block 6, carries the operative member 2, while its crankshaft 7 is kinematically associated with rotary motion drive thereof through a crank-and-pitman mechanism 8 and an arm 9 which is articulated to a pitman 10 of the crank-and-pitman mechanism 8 and locked-in with the crankshaft 7 of the slot-and-crank mechanism, the length of the arm 9, i.e., the distance AB (FIGS. 1 and 3) is substantially greater than the crank radius R of the crankshaft 7.

Annular bearings 11 (FIGS. 2 and 4) of the crankshaft 7 of the slot-and-crank mechanism, or annular bearings 12 (shown schematically) of a crankshaft of the crank-and-pitman mechanism 8 are mounted in a frame 14 (FIG. 2) of the crank press, or in a housing 15 (FIG. 4) of a frame 16 of the radial squeezer, with a possibility of traversing with respect to the frame during reciprocating motion of the operative member 2, thereby pressure-shaping of the workpiece being handled across the transverse section (diameter, height) thereof, i.e., bringing together the operative members of a radial squeezer, or changing the die-to-die spacing in a crank press.

Among the abovementioned versions considered hereinbelow is only one, wherein the annular bearings 11 of the crankshaft 7 of the slot-and-crank mechanism traverse with respect to the frame, as the traversing of the annular bearings 12 of the crankshaft 13 occurs in a similar way.

The slotted link 5 of the slot-and-crank mechanism of the crank press (FIGS. 1 and 2) slides along ways 17 of the frame 14, while the movable portion of the operative member 2 travels towards a stationary portion 18 thereof fixed on the frame 14, or away therefrom in a direction indicated by the arrows.

The frame 14 has one more way 19 adapted to prevent the slotted link 5 from rotating round its own axis in the case of the circular ways 17. The slotted link 5 is articulated (in a conventional manner) to the crankshaft 7 through the slide block 6 so that the latter serves at the same time as the bearing for the crank of the crankshaft 7.

In order to change the die-to-die spacing in the course of reciprocating motion of the operative member 2, the frame 14 accommodates a swivel bearing box 20, wherein there are located eccentrically to the axis D of its rotation the annular bearings 11 (FIG. 2) of the crankshaft 7, for said annular bearings 11 to traverse with respect to the frame 14 of the press, the geometrical crank axis C of said crankshaft 7 passing in front of the axis D (FIG. 1) of rotation of the bearing box 20 and the axis B of the crankshaft 7.

With such an arrangement of the axes B and D of rotation of the crank of the crankshaft 7 and of the bearing box 20, respectively the forces applied to the operative member, are resolved into the two components of which one exerts upon the drive of the bearing box 20, while the other, upon the crank-and-pitman mechanism 8, the magnitudes of the components of the working force being proportionate to the distances AC and BC between the axes B and C of rotation. By appropriately selecting the ratios between said distances one can reduce the force exerted upon the operative member 2, thereby adding to speed and workability of the crank-and-pitman mechanism 8.

In the herein-proposed embodiment of the invention the distance BC equal the crank radius R of the crankshaft 7, while the distance AC is equal to the segment E which is longer than the radius R.

All the described above concerns equally the radial squeezer as illustrated in FIGS. 3 and 4, with the sole exception that non reference letter symbol D denoting the respective axis is not illustrated in those figures.

The swivel bearing box 20 (FIG. 1) is mounted in ways 21 of the frame 14 and is imparted motion in a direction indicated by the arrowheads, through a link 22 articulated to the bearing box 20 and actuated by any drive (not shown).

With such a constructional arrangement of the crank press its operation occurs as follows.

Rotation of the crankshaft 13 of the crank-and-pitman mechanism 8 is imparted through the pitman 10 and the arm 9 to the crankshaft 7 of the slot-and-crank mechanism. The crankshaft 7 performs oscillating motion while rotating in the annular bearings 11 of the swivel bearing box 20 and, while acting through the slide block 6, causes the slotted link 5 along with the movable portion of the operative member 2 to reciprocate towards the stationary portion 18 thereof, thus working in pressure-shaping of the blank being handled that has been put in between the traversable and the stationary portions of the operative member 2. The swivel bearing box 20 is fixed stationary at that instance.

In order to adjust the die space, i.e., to change the distance between the movable and the stationary portions of the operative member 2, one must turn the swivel bearing box 20 in the required direction through the link 22. Thus, clockwise rotation of the bearing box 20 reduces the die-to-die spacing so that the point B moves downwards along an arc pathway of a radius equal to the distance F, whereas counterclockwise rotation of the bearing box 20 increases the die-to-die spacing. Inasmuch as the arm 9 is articulated to the pitman 10, the angle therebetween changes accordingly, thus enabling adjustment of the die-to-die spacing within preset limits without resorting to any additional contrivance.

As it has been hereinbefore stated the radial squeezer has a plurality of the operative members 2 (FIG. 3) and the same number of the devices 1 for converting rotary motion of the drive into reciprocating motion of the operative member, all the operative members 2 are adapted to traverse in synchronism with one another towards the centre which is termed axis of forging, or away therefrom. The workpiece L being handled travels lengthwise said axis of forging.

In each of the devices 1 the slotted link 5 of the slot-and-crank mechanism travels along a way 23 of the housing 15 which is made swivel, and its axis of rotation coincides with the axis of forging. The housing 15 swivels along ways 24 (FIG. 3) of the stationary frame 16 from air or hydraulic cylinders 25, the barrel of each of said cylinders being articulated, by any known means, to the frame 16 of the machine. A rod 26 of each of the air cylinder 25 is articulated, through a hinge pin 27, to the housing 15.

The rotary housing 15 accommodates the annular bearings 11 (FIG. 4) of each of the crankshafts 7, while the annular bearings 12 of each of the crankshafts 13 of crank-and-pitman mechanism 8 are located in the frame 16.

In order that all the operative members 2 traverse in synchronism, all the devices 1 for converting rotary motion of the drive into reciprocating motion of the operative members 2 are interconnected through gears 28 (FIG. 3) set on the crankshafts 13 of the crank-and-pitman mechanism, and through idle gears 29 put in between the gears 28 and being in constant mesh with one another and with the gears 28, thus forming a closed gear train indicated with a dotted line in FIG. 3 so as not obscure the drawing. One of the crank-shafts 13 (FIG. 4) is connected to the drive through a coupling 30 of any conventional type.

With such a constructional arrangement of the radial aqueezer its operation occurs as follows.

Rotation from the drive 3 is imparted, through the coupling 30, to the crankshaft 13 of the crank-and-pitman mechanism 8 of one of the devices 1, from whence it is transmitted, through the gear (FIG. 3) and the idle gears 29 interconnecting all the crankshafts 13 via the gears 28, to said shafts 13. The crankshafts 13 impart oscillating motion, through the pitman 10 and arms 9, to the crankshafts 7 of the slot-and-crank mechanisms. The crankshafts 7, while performing oscillating motion, impart reciprocating motion, through the slotted links 5, to the operative members 2 which traverse in synchronism towards the axis of forging along which the workpiece L being handled is located.

Whenever it is necessary to make a thinned portion of the blank, the operative members 2 are brought together. To this end, without interrupting reciprocating motion of the operative members 2, a power fluid is fed to the respective chambers of the cylinders 25, so that the housing 15 is turned through an angle with respect to the frame 16 under the effect of the moving rods 26, while the axes of the shafts 13 remain immovable and the axes of the shafts 7 travels along the circumference of a certain radius with respect to the axes of the shafts 13, so that the crankshafts 7 turn with respect to the housing 15. While the crankshafts 7 are turning the slotted links 5 traverse and cause the operative members 2 to travel towards the centre, thus thinning the workpiece being handled. The workpiece may rotate in this case round its own axis at some speed.

In order to bring apart the operative members 2 the housing 15 must be turned in the opposite direction by feeding power fluid medium to the other chamber of the cylinders 25.

What is claimed is:

1. A forging machine comprising: a frame (14,16) having an opening longitudinal to the axis of said frame permitting a workpiece (L) to be moved, hammer means (2) equally spaced around the workpiece (L); main crankshaft means (7) for imparting reciprocation to said hammer means (2); a driving crankshaft means (13) of a crank gear mechanism (8) for transmitting rotary movement to said driving crankshaft means (7), wherein: the kinematic coupling of the main crankshaft means (7) with the driving crankshaft means (13), is accomplished by means of a lever (9) rigidly secured to the main crankshaft means (7) and pivotally connected to a connecting rod (10) of said crank gear mechanism (8).

2. A forging machine according to claim 1, wherein: the main crankshaft means (7) crank axis (C) is disposed between the axis (B) of rotation of said crankshaft means and the axis (A) of the pivot joint coupling the lever (9) and the connecting rod (10).

3. A forging machine according to claims 1 or 2 wherein: support bearings (11) (12) of the main crankshaft means (7) and of the driving crankshaft means (13) are installed in different housings which are concentrically rotatable relative to one another with respect to the axis of the workpiece movement.

* * * * *